United States Patent [19]

Crook et al.

[11] Patent Number: 4,544,030

[45] Date of Patent: Oct. 1, 1985

[54] SHELL NOZZLE

[75] Inventors: Mikel S. Crook; Douglas E. Decker, both of La Crosse, Wis.

[73] Assignee: American Standard Inc., New York, N.Y.

[21] Appl. No.: 523,210

[22] Filed: Aug. 15, 1983

[51] Int. Cl.[4] ..... F28F 9/00

[52] U.S. Cl. ..... 165/159; 165/134 R; 165/178; 220/465; 285/189

[58] Field of Search ..... 165/157, 159, 134 R, 165/174, 178; 285/189, 208, 209; 137/590, 592; 220/465, 466, 5 A, 66, 67

[56] References Cited

U.S. PATENT DOCUMENTS

| | | | |
|---|---|---|---|
| Re. 26,765 | 1/1970 | Holmes | 165/134 |
| 43,938 | 8/1864 | Wethered | 165/134 R |
| 370,865 | 10/1887 | Hague et al. | 165/134 R |
| 562,067 | 6/1896 | Copeland | 285/189 |
| 935,984 | 10/1909 | Hinck | 285/208 |
| 1,392,204 | 9/1921 | Nichols | 220/466 |
| 2,080,326 | 5/1937 | Maddock | 220/465 |
| 2,099,113 | 11/1937 | Hollnagel | 220/466 |
| 2,710,630 | 6/1955 | Greer | 285/208 |
| 2,916,182 | 12/1959 | Rollins et al. | 220/465 |
| 3,325,193 | 10/1964 | Castello | 285/189 |
| 3,763,262 | 10/1973 | Sato et al. | 165/174 |
| 3,880,317 | 4/1975 | Arnett | 220/85 F |
| 4,078,292 | 3/1978 | Porter | 165/174 |
| 4,254,826 | 3/1981 | Adams | 165/158 |

FOREIGN PATENT DOCUMENTS

| | | | |
|---|---|---|---|
| 432955 | 9/1967 | Switzerland | 285/189 |

*Primary Examiner*—Sheldon J. Richter

*Attorney, Agent, or Firm*—Ronald M. Anderson; Carl M. Lewis; William J. Beres

[57] ABSTRACT

A nozzle for a shell of a heat exchanger particularly useful as the outlet nozzle thereof in which an outlet pipe extends into the shell, and a bellmouth orifice is provided at the end of the pipe. A mounting plate is attached to the orifice and extends between the perimeter of the orifice and the shell, for minimizing the flow of fluid behind the orifice. Vents are provided in the plate for equalizing the pressures on opposite sides of the plates.

3 Claims, 5 Drawing Figures

SHELL NOZZLE

BACKGROUND OF THE INVENTION

1. Technical Field

The present invention pertains generally to the field of shells for heat exchangers such as intercoolers, and pertains specifically to a nozzle therefor to reduce pressure drop.

2. Prior Art

In many operations or processes fluids are handled and conditioned under circumstances in which it is desirable to minimize the pressure drop which the fluid experiences. For example, intercoolers having a coil, tube bundle or the like disposed within a shell are frequently used in large compressor operations having multiple stages of compression. The intercooler reduces the temperature of the fluid being compressed so that the inlet temperature of a subsequent stage of compression is substantially less than the temperature at the outlet of a previous stage of compression. The power required to achieve the final pressure is reduced by decreasing the inlet temperature at each compression stage. Particularly in very large systems, the decreased operating costs can quickly pay for the increased costs of installing an intercooler, even though the intercooler can be quite costly.

Just as temperature reduction between stages of compression is highly desirable, pressure loss between stages is highly undesirable. The power required to achieve the final level of compression for the fluid increases as the pressure is reduced at each successive inlet of compression stages. Thus, it is extremely important to minimize the pressure loss in a compressor intercooler to minimize operating costs.

Given unlimited freedom of design, engineers could readily design heat exchangers to perform the necessary temperature reduction while minimizing pressure drop. Unfortunately, in the typical compressor, the size, shape and location for an intercooler is substantially limited. Normally, the locations of the inlet and outlet nozzles and the size of the pipes leading to and from the intercooler are fixed; thus, in designing an intercooler for a compressor, the engineer is faced with severe design limitations.

Experience has shown that in many intercooler designs as much as eighty percent (80%) of the total pressure drop experienced in the intercooler occurs at the inlet and outlet nozzles. About half of the pressure drop experienced at the nozzles, or about forty percent (40%) of the total pressure drop in the intercooler, is experienced at each of the nozzles. The present invention deals with a design for minimizing pressure drop at the outlet nozzle.

The effectiveness of a bellmouth orifice for reducing pressure losses in some applications is well known. These have not been used, however, on shells of intercoolers, aftercoolers, knockout drums or other high pressure devices having curved shells because of various manufacturing drawbacks and design limitations. As mentioned previously, the size and location of the connecting pipe is fixed or severely limited. Attaching the periphery of a bellmouth orifice directly to the cylindrical shell wall or to a curved shell cover or end presents many manufacturing difficulties, and the high pressures attained in the shell make it impractical to provide a flat plate area on the shell or end to which the orifice can be attached. To withstand the pressures the plate would have to be unacceptably thick. The present invention overcomes these and other difficulties and makes the use of a bellmouth orifice for a high pressure shell outlet practical.

SUMMARY OF THE INVENTION

It is therefore one of the principal objects of the present invention to provide a nozzle for a shell which is particularly useful as an outlet nozzle of a high pressure shell, and which substantially reduces the pressure drop normally experienced at the outlet nozzle.

Another object of the present invention is to provide an outlet nozzle for a shell which can be mounted easily to the shell, either along the shell wall or at one of the shell ends or covers, and which gathers and directs the flow of fluid toward the nozzle opening while minimizing flow behind the nozzle.

A still further object of the present invention is to provide a nozzle for a shell which minimizes the effects of the pressure within the shell on the nozzle mounting structure, and which can be used even for high pressure applications.

These and other objects are achieved in the present invention by providing a bellmouth orifice on the end of a pipe which extends into the shell. A mounting plate is disposed on the periphery of the orifice and extends therefrom to the inner surface of the shell. Two embodiments are disclosed herein, one for mounting the orifice in the cylindrical shell wall, and the other for mounting the orifice to one of the curved shell ends. The mounting plate minimizes flow behind the orifice, thereby further reducing pressure drop. Vents are provided in the mounting plate to equalize pressure on opposite sides of the plate.

Additional objects and advantages of the present invention will become apparent from the detailed description and the accompanying drawing.

DETAILED DESCRIPTION OF THE PREFERRED EMBODIMENT

Figure 1:
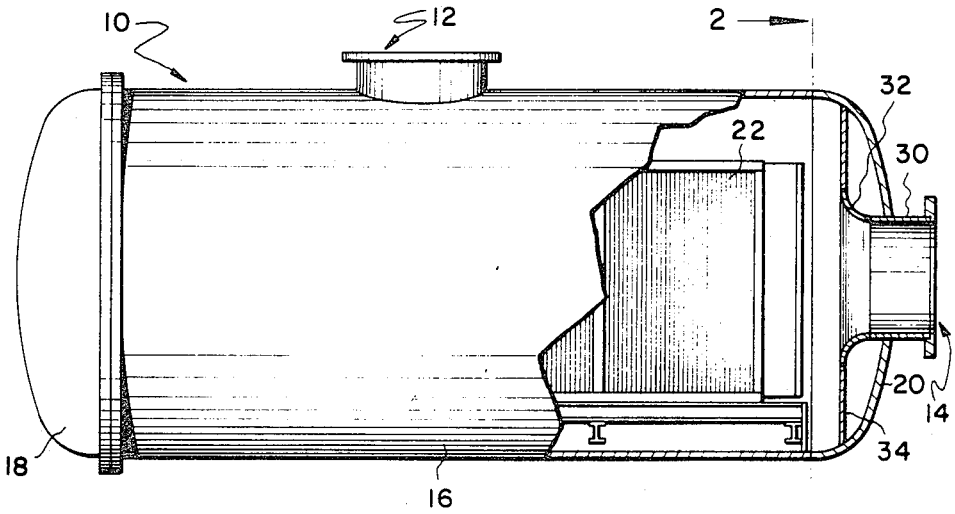
FIG. 1 is a side elevational view, partially broken away, of an intercooler having an outlet nozzle embodying the present invention mounted at one end of the shell.
Figure 2:
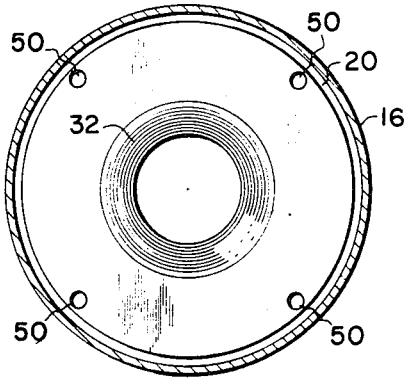
FIG. 2 is a cross-sectional view of the intercooler shown in FIG. 1, taken on line 2—2 of the latter Figure.
Figure 4:
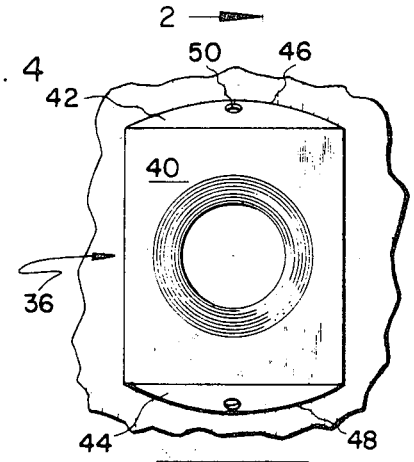
FIG. 4 is a fragmentary view of the outlet nozzle shown in FIG. 3, taken generally along line 4—4 of FIG. 3.
Figure 5:
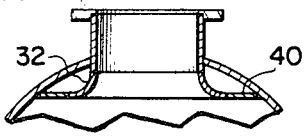
FIG. 5 is a cross-sectional view of the outlet nozzle shown in FIG. 3, taken on line 5—5 of the latter Figure.

Referring now more specifically to the drawings, and to FIG. 1 in particular, numeral 10 designates a heat exchanger such as an intercooler having an inlet nozzle 12 and an outlet nozzle 14, the outlet nozzle being a first embodiment of the present invention. The heat exchanger can be of any conventional construction wherein a cylindrical shell including a side wall 16 and ends or covers 18 and 20 provides an enclosure through which a process fluid may flow in heat exchange relationship with a second fluid flowing in a coil or coils 22 disposed in the shell. The structure of the heat exchanger itself, except for the outlet nozzle structure, is conventional and will not be described further herein. It should be understood that the present invention can be used advantageously in many different fluid handling devices such as intercoolers, aftercoolers or other heat exchangers having shells regardless of whether the heat exchange unit provided therein is of the tube, fin tube, plate or other types. The present nozzle can be used in virtually any shell through which a fluid passes and in which pressure drop is a concern, such as knockout drums.

In the embodiment shown in FIG. 1, which is for a fin-tube heat exchanger, the outlet nozzle 14 includes a pipe 30 extending into the shell and having attached at its inner end a bell-shaped body 32 defining a bellmouth orifice. The pipe can be of any size desired or dictated by the compressor system requirements, and is normally welded or otherwise attached to, and sealed with the shell where the pipe passes through the shell. In the example shown, the pipe passes through and is sealed with shell cover 20 at the center of the cover; however, this may not always be the case. The pipe, in some particular designs, may not be centrally located in the cover, or, as will be described subsequently, the pipe may enter the shell at the side wall.

In the first embodiment of the invention an annular mounting plate 34 is attached at the periphery of the body defining the bellmouth orifice and extends between the periphery and the inner surface of the shell, in this case the inner surface of cover 20. The plate is a substantially flat body having an opening for the orifice and a round perimeter. Normally, the plate will be attached to the shell and to the bellmouth either by a continuous weld bead, by spot welds, or by an intermittent weld. The plate prevents the process fluid flowing towards the outlet nozzle from flowing behind the bellmouth orifice which is disposed inwardly in the shell from the outermost portion of cover 20.

Figure 3:
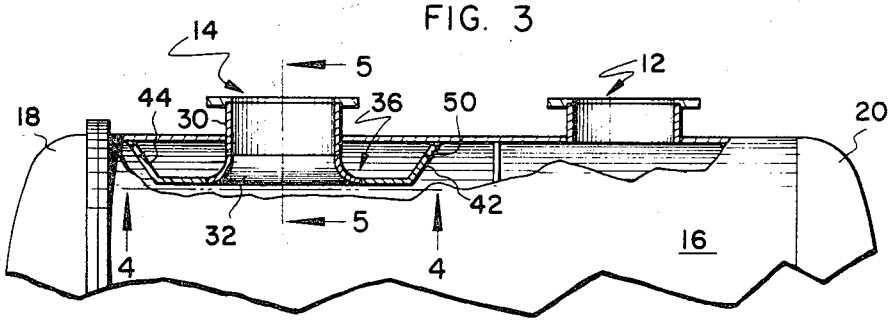
FIG. 3 is a fragmentary view, partially broken away, of an intercooler having an alternative embodiment of an outlet nozzle according to the present invention mounted in the cylindrical shell wall.

Turning now to FIG. 3, an alternative embodiment of the outlet nozzle is shown. The intercooler again consists of a shell having a side wall 16 and ends or covers 18 and 20, and inlet and outlet nozzles 12 and 14. In FIG. 3, however, the outlet nozzle is shown mounted in the cylindrical side wall of the shell. In this embodiment pipe 30 extends through the side wall and has a body 32 defining a bellmouth orifice mounted on the inner end thereof. As in the structure described previously, the pipe is welded or otherwise attached to the shell where it passes through the side wall. A mounting plate, generally indicated by numeral 36, is provided at the periphery of the bellmouth orifice; however, the mounting plate is shaped differently than that shown in FIG. 1. Mounting plate 36 includes a substantially flat, rectangular first portion 40 which is attached to the periphery of the bellmouth orifice and extends therefrom to the downwardly sloping sidewall 16 of the shell along the longitudinal shell direction. From this substantially flat first section two upwardly angled end plates 42 and 44 having curved edges 46 and 48 join the first substantially flat portion to the shell side wall 16 above the plate. The edges of the flat first portion 40 and the angled end plates 42 and 44 are normally welded to the shell. This mounting plate structure, including the first portion 40 and the upwardly extending end portions 42 and 44, substantially minimizes flow behind the orifice, allowing the fluid to flow smoothly toward and into the orifice.

If the mounting plates of either embodiment are welded to the shell and bellmouth by continuous beads at their peripheries, sealed chambers through which the pipe extends are formed between the mounting plates and the shell. Depending on the application for the device, relatively high pressures can be introduced to the shell, which could cause a substantial pressure differential on opposite sides of the plate, leading to failure of the mounting plate. The plates could be selected to have sufficient strength to withstand the pressure differential; however, the preferred remedy is to provide one or more vent holes 50 in the mounting plate to allow equilization of the pressures on opposite sides of the plate. The selection of the number, size, and location of the vents in the mounting plates for either of the embodiments disclosed above depends somewhat on the overall operation of the device in which it is used. For example, if an intercooler is frequently started and stopped and rapidly achieves an intense or highly elevated pressure within the shell, more or larger vents may be required, or the mounting plate may be required to be thicker than if the intercooler slowly achieves a substantially lower pressure. This is to prevent failure of the mounting plate resulting from the delay in achieving pressure equalization on opposite sides thereof. If the pressure increase is slow, the mounting plates can be relatively thin with a minimal amount of relatively small vents, and the plate will not fail since pressures will equalize during the slow pressure build-up. An alternative to the vent holes is to allow space between the mounting plate and shell, by providing an intermittent weld bead between the plate and the shell.

Since the bellmouth orifices are not mounted directly to the shell, the difficulties previously described which are encountered in welding or securing a bellmouth orifice to the shell are eliminated. The flat plate to which the orifice is mounted need not be substantially thick since extreme pressure differentials on opposite sides thereof are not encountered. The advantages of using cylindrical shells as pressure contaminant vessels are retained, and the advantage of a bellmouth orifice is incorporated therewith.

Fluid flowing into the intercooler enters at inlet nozzle 12, passes through the heat exchange coil 22 and leaves through outlet nozzle 14. The bellmouth orifice at the outlet substantially reduces the pressure drop occurring at the outlet by gathering the flow toward the outlet pipe without creating vortices or other areas of inefficient fluid flow. The mounting plates eliminate flow behind the nozzle and direct fluid flow toward the orifice.

Although two embodiments of a shell nozzle have been shown and described in detail herein, various other changes may be made without departing from the scope of the present invention.

We claim:

1. An outlet nozzle for minimizing the pressure drop in the fluid flowing out of a pressurized fluid handling device having a continuously curved wall portion, comprising:

pipe means penetrating said continuously curved wall portion of said fluid handling device and extending therethrough into the interior of said device, said pipe means being in sealing engagement with said continuously curved wall portion;

a bell-shaped orifice body having a mouth end, the end of said orifice body opposite said mouth end being attached to said pipe means within the interior of fluid handling device so that fluid flowing into said mouth end of said orifice body is gathered and directed through said body into said pipe means; and mounting plate means disposed about the periphery of said mouth end of said orifice body and extending therefrom into contact with said continuously curved wall portion of said fluid handling device, for eliminating flow behind and directing fluid flow into said bell-shaped orifice body, said mounting plate means having a rectangular flat portion, a first end plate and a second end plate, said first and said second end plates each having a curved edge and being attached to said rectangular portion at opposite edges of said rectangular portion, said rectangular portion being attached to the periphery of said mouth end of said orifice body and extending therefrom so that the opposite edges of said rectangular portion other than said opposite edges to which said first and said second end plates are attached extend to the curved sidewall of said fluid handling device, said end plates being angled from said rectangular portion so that said curved edges of said end plates extend to said curved sidewall along the entire length of said curved edges.

2. The outlet nozzle according to claim 1 wherein said mounting plate means defines a vent hole.

3. The outlet nozzle according to claim 2 wherein said curved edges of said first and second end plates and said opposite edges of said mounting plate extending to said curved side wall are welded to said curved sidewall and a vent hole is defined by said mounting plate means in at least one of said first and said second end plates.

* * * * *